United States Patent [19]

Tomono et al.

[11] Patent Number: 5,004,666

[45] **Date of Patent: * Apr. 2, 1991**

[54] TONER FOR USE IN DEVELOPING ELECTROSTATIC IMAGES

[75] Inventors: Makoto Tomono, Hino; Noriyoshi Tarumi, Tama; Masayuki Sato, Ohtsuki, all of Japan

[73] Assignee: Konica Corporation, Tokyo, Japan

[ * ] Notice: The portion of the term of this patent subsequent to May 1, 2007 has been disclaimed.

[21] Appl. No.: 501,611

[22] Filed: Mar. 29, 1990

Related U.S. Application Data

[63] Continuation of Ser. No. 147,024, Jan. 19, 1988, Pat. No. 4,921,771, which is a continuation of Ser. No. 65,093, Jun. 18, 1987, abandoned, which is a continuation of Ser. No. 801,376, Nov. 22, 1985, abandoned, which is a continuation of Ser. No. 550,992, Nov. 14, 1983, abandoned, which is a continuation of Ser. No. 279,673, Jul. 1, 1981, abandoned, which is a continuation of Ser. No. 50,475, Jun. 20, 1979, abandoned, which is a continuation of Ser. No. 741,408, Nov. 12, 1976, abandoned, which is a continuation-in-part of Ser. No. 408,008, Oct. 19, 1973, abandoned.

[30] Foreign Application Priority Data

Oct. 21, 1972 [JP] Japan ..... 47-104865
Oct. 23, 1972 [JP] Japan ..... 47-105289

[51] Int. Cl.[5] ..... G03G 9/08

[52] U.S. Cl. ..... 430/110; 430/99; 430/903; 430/109; 526/934

[58] Field of Search ..... 430/109, 110, 99, 903; 526/934

[56] References Cited

U.S. PATENT DOCUMENTS

| | | | |
|---|---|---|---|
| Re. 25,136 | 3/1962 | Carlson | 430/109 |
| 3,107,236 | 10/1963 | Thompson | 526/158 |
| 3,239,465 | 3/1966 | Rheinfrank | 430/109 |
| 3,558,492 | 1/1971 | Proskow | 430/109 X |
| 3,656,857 | 4/1972 | Sergely | 401/142 |

*Primary Examiner*—David Welsh
*Attorney, Agent, or Firm*—Jordan B. Bierman

[57] ABSTRACT

A toner for developing electrostatic images is disclosed which comprises a coloring agent, a styrene homopolymer or copolymer with a vinyl monomer or moners, and polypropylene in an amount between about 0.02 and 40 parts by weight per 100 parts by weight of the styrene homopolymer or copolymer.

13 Claims, No Drawings

TONER FOR USE IN DEVELOPING ELECTROSTATIC IMAGES

This application is a continuation of application Ser. No. 147,024, filed Jan. 19, 1988 U.S. Pat. No. 4,921,771; which is a continuation of application Ser. No. 65,093, filed Jun. 18, 1987 now abandoned, which is a continuation of application Ser. No. 801,376, filed Nov. 22, 1985 now abandoned, which is a continuation of application Ser. No. 550,992, filed Nov. 14, 1983 abandoned, which is a continuation of application Ser. No. 279,673, filed Jul. 1, 1981 abandoned; which is a continuation of application Ser. No. 50,475, filed Jun. 20, 1979 abandoned, which is a continuation of application Ser. No. 741,408, filed Nov. 12, 1976 abandoned; which is a continuation-in-part of application Ser. No. 408,008, abandoned, filed Oct. 19, 1973; which claims the priority of Japanese Applications Nos. 105289/72, abandoned, filed Oct. 23, 1972, and 104865/72, abandoned, filed Oct. 21, 1972.

This invention relates to toners for use in developing electrostatic images formed by electrophotography, facsimile recording, electrostatic printing and the like.

Development of electrostatic images has heretofore been carried out by various processes. The process may be roughly divided into two major methods, one of which is wet development where developers comprising finely divided particles of various pigments or dyes dispersed in insulating organic solvents are used therefor, and the other of which is so-called dry development including such processes, for example, as cascade, hair brushing, magnetic brushing, impression and powder cloud, where fine grain developers, which are called toners, comprising natural or synthetic resins having dispersed therein coloring agents such as carbon black and the like are used. The present invention pertains to toners which are used in the latter method, i.e. dry development.

After development of an electrostatic image by use of a toner, fixation of the image is effected. Generally, however, the fixation is carried out by melt fixing a toner image obtained by the development directly onto a photoconductive element or electrostatic recording element having thereon the electrostatic image, or transferring the toner image obtained by the development from the photoconductive element or electrostatic recording element onto a transfer sheet such as a sheet of ordinary paper and then melt fixing the transferred toner image on the transfer sheet. In that case, the melt-fixing of the toner image is effected by either contact with solvent vapor or by application of heat. In practicing the application of heat, a so-called non-contact heating process by means of an electric oven and a pressure-contact heating process by means of a heating roller are generally adopted.

In the pressure-contact heating process by means of the heating roller, fixation of a toner image transferred to adhere to a sheet onto which the image is to be fixed is carried out by passing said image through the surface of the roller while being contacted under pressure, said surface of the roller being formed from a material having non-sticking property to the toner. This process is generally called a heating roller fixing method. The method is extremely effectively adaptable to an electrophotographic copying machine of the image transfer type especially having as its object a high speed reproduction. This is because, the surface of the heating roller is brought into contact directly with the surface of the toner image of the sheet onto which said image is to be fixed, and hence an extremely high thermal efficiency may be attained at the time of melt fixing the toner image onto the sheet onto which said image is to be fixed, whereby the fixation can be carried out rapidly. In this method, however, the surface of the fixing roller is brought into contact with the toner image in a hot melt state, and hence a part of the toner image adheres to and remains on the surface of the fixing roller, whereby the part of the toner image remaining on the surface of the fixing roller is transferred again back onto the surface of a subsequent sheet onto which the toner image is to be successively fixed, thereby causing a so-called offset phenomenon which results in staining the sheet in some cases. For that account, it has heretofore been deemed as one of the indispensable requisite for the successful hot roller fixing method to avoid adhesion of a toner to the surface of roller.

For the purpose of avoiding adhesion of toner to the surface of fixing roller, there have heretofore been adopted some measures, for example, a method in which the surface of the roller is formed from a material having excellent non-sticking property to the toner, such as fluorocarbon resins, and simultaneously said surface of roller is further covered with a thin film of an offset-preventing liquid, such as silicone oil, which liquid is constantly fed in a given amount to the surface of roller. This method is extremely effective in the prevention of offset of the toner. On the other hand, however, the method has such drawbacks that the offset-preventing liquid is heated to evolve an undesirable odor. Further this method requires an additional means for feeding the offset-preventing liquid is required and hence the apparatus as the whole becomes complicated in its mechanism and at the same time becomes expensive because a high accuracy is required for obtaining the results high in stability of reproduction. In the case where no offset-preventing liquid is supplied, however, the toner adheres to the surface of the fixing roller, whereby the offset phenomenon occurs. In spite of all these drawbacks, there is no alternative but to use the off-set preventing liquid. Thus is the hot roller fixing method carried on.

An object of the present invention is to provide a toner for use in developing electrostatic images, by the use of which an excellent hot roller fixation of the images can be effected efficiently without occurrence of the offset phenomenon of toner even when a fixing roller is supplied without any offset-preventing liquid. We have found that the object of the present invention as aforesaid can be accomplished by use of a toner for use in developing electrostatic images, said tone comprising (a) a coloring agent, (b) a styrene type resin, (c) at least one low molecular weight propylene. Still further, we have discovered that the aforesaid object an be accomplished likewise by use of a toner for use in developing electrostatic images, said toner comprising (d) a paraffin wax together with or without (e) a metal salt of fatty acids in addition to the aforesaid (a), (b), and (c).

When polyethylene and paraffin wax are used, either alone or in combination, the resultant toner does not stick to a Teflon coated fixing roller. However, we have discovered that the use of polypropylene in a toner, for use in developing electrostatic images with an electrophotographic copying machine equipped with a magnetic brush developing apparatus, produces superior development characteristics.

More specifically, a toner containing paraffin wax or polyethylene alone tends to "bloom out" with an increase in the number of transfer sheets copies. The thus bloomed paraffin wax or polyethylene adheres to the carrier surface and thereby alters the frictional charge properties of the toner. Further, the bloomed paraffin wax or polyethylene sticks to the sleeve surface of the development apparatus. This reduces the effectiveness of the magnetic brush and consequently prevents uniform image development.

In contradistinction, the use of polypropylene in a toner for developing electrostatic images does not result in the above-described disadvantages. Therefore, a large number of copies can be obtained during a continuous process of satisfactory development.

By virtue of the use of the present toner for use in developing electrostatic images, it becomes possible to conduct an excellent hot roller fixation in an efficient manner without bringing about the offset phenomenon even when the fixing roller is not provided with the offset-preventing liquid. Thus, not only the mechanism of a fixation apparatus may be simplified but also the efficiency, for example, accuracy, stability and reliability, of a high speed copying machine comprising such an apparatus for the hot roller fixation and, moreover, the cost of the high speed copying machine may be reduced. Accordingly, the design of a superhigh speed copying machine may be quite easily worked when it is so designed as to use the present toner.

In the present toner, any suitable pigments dyes may be used as the coloring agent specified in the present invention. For example, there may be used carbon black, nigrosin dyes, Anilin Blue, Calco Oil Blue, Chrome Yellow, Ultramarine Blue, Du Pont Oil Red, Qinoline Yellow, Methylene Blue Chloride, Phthalocyanine Blue, Malachaite Green Oxalate, lampblack, Rose Bengal and mixtures thereof. The amount of any of these coloring agents to be contained in the present toner should be sufficient to color the toner so that a visible image may be formed at the time of development.

In the present toner, a styrene type resin is used as a resin component of the toner. The styrene type resin may be either a homopolymer of styrene or copolymer of styrene with other vinyl type monomers. Monomers for forming the said copolymer include p-chlorostyrene; vinyl naphthalene; such ethylenically unsaturated monoolefins, for example, as ethylene, propylene, butylene and isobutylene, such vinyl esters, for example, as vinyl chloride, vinyl bromide, vinyl fluoride, vinyl acetate, vinyl propionate, vinyl benzoate and vinyl butyrate; such esters of $\alpha$-methylene aliphatic monocarboxylic acid, for example, as methyl acrylate, ethyl acrylate, n-butyl acrylate, isobutyl acrylate, dodecyl acrylate, n-octyl acrylate, 2-chloroethyl acrylate, phenyl acrylate, methyl $\alpha$-chloroacrylate, methyl methacrylate, ethyl methacrylate, and butyl methacrylate; acrylonitrile; methacrylonitrile; acrylamide; such vinyl ethers, for example, as vinyl methyl ether, vinyl isobutyl ether and vinyl ethyl ether; such vinyl ketones, for example, as vinyl methyl ketone, vinyl hexyl ketone and methyl isopropenyl ketone; and such N-vinyl compounds, for example, as N-vinyl pyrrole, N-vinyl carbazole, N-vinyl indole and N-vinyl pyrrolidene. One or two or more of these monomers may be copolymerized with styrene monomer. Suitable styrene resins have an average molecular weight of about 3000 or more and the styrene content of the resin is preferably at least about 25% by weight based on the total weight of the styrene type resin.

Thermoplastic resins prepared by mixing a styrene type resin with other resins may also be used as resin component of the present toner. Other resins capable of being mixed with the styrene type resin include homopolymers or copolymers of the following monomers: vinyl naphthalene; such vinyl esters, for example, as vinyl chloride, vinyl bromide, vinyl fluoride, vinyl acetate, vinyl propionate, vinyl benzoate and vinyl butyrate; such esters of $\alpha$-methylene aliphatic monocarboxylic acid, for example, as methyl acrylate, ethyl acrylate, n-butyl acrylate, isobutyl acrylate, dodecyl acrylate, n-octyl acrylate, 2-chloroethyl acrylate, phenyl acrylate, methyl $\alpha$-chloroacrylate, methyl methacrylate, ethyl methacrylate and butyl methacrylate; acrylonitrile; methacrylonitrile; acrylamide; such vinyl ethers, for example, as vinyl methyl ether, vinyl isobutyl ether and vinyl ethyl ether; such vinyl ketones, for example, as vinyl methyl ketone, vinyl hexyl ketone and methyl isopropenyl ketone; and such N-vinyl compounds, for example, as N-vinyl pyrrole, N-vinyl carbazole, N-vinyl indole and N-vinylpyrrolidene. Alternatively included are, for example, such non-vinyl type thermoplastic resins as resin-modified phenol formalin resins, oil-modified epoxy resins, polyurethane resins, cellulose resins and polyether resins. In the case where the above-mentioned resin is used in admixture with the styrene type resin, both resins are preferably mixed with each other in such a manner that the styrene component may be at least about 25% by weight based on the total weight of the resulting resin. This is because the non-sticking property of the toner to the fixing roller is closely related to the amount of styrene component of the resin present in the toner and there is such a tendency that the non-sticking property of the toner to the fixing roller is lowered with the decrease in amount of the styrene component of the resin.

In the present toner, at least one low molecular weight polypropylene is used as a toner additive which contributes towards the achievement of non-sticking effect of the toner.

When polypropylene is incorporated alone in the toner, it is quite effective in improving the non-sticking property of the toner to the fixing roller. In some cases, however, polypropylene is low in compatibility with the styrene type resin and hence it is sometimes not sufficiently compatible with the resin component in the toner, whereby the resulting toner is liable to agglomeration. However, when the amount of polypropylene is reduced with the view of avoiding the agglomeration of toner, the non-sticking property of the toner to the fixing roller is lowered. On the other hand, when paraffin wax is added alone to the toner, it is liberated, because of its relatively low melting point, on the surfaces of particles of the toner, whereby the resulting toner is likewise liable to agglomeration. Moreover, in that case, the melting point of the toner itself is lowered and hence fluidity of the toner is increased when said toner is subjected to melt-fixing by application of heat, whereby the temperature range within which the non-sticking action of the toner may be achieved leans to a relatively low side and thus the range is disadvantageously narrowed. However, such disadvantages as may be seen in the cases where polypropylene and paraffin wax are singly incorporated in the toner may be overcome by incorporation into the toner of a combination of at least one polypropylene compound with paraffin wax. That is, when the above combination is incorporated into the toner, compatibility of the polypropylene compound to the resin component of the toner is improved and, at the same time, liberation of the paraffin wax is suppressed, whereby no agglomeration of the resulting toner takes place. A further advantage is that by suitably varying the proportion of the polypropylene compound to the paraffin wax in a combination thereof, the temperature range within which the resulting toner exhibits its non-sticking action can be enlarged to the desired range. In addition thereto, the non-sticking action of the toner on the fixing roller is further improved by use of the said combination of the toner.

The polypropylene compound used in the present toner is preferably such that not only it is high in compatibility to the styrene type resin component as much as possible but also it has a relatively low molecular weight because those as having considerably high melting points are not preferable for selecting a desired melt-fixing temperature. In the case of polypropylene, those which have a number average molecular weight of from about 2000 to about 6000 are usable likewise. The paraffin wax used in the present toner in combination with the polypropylene compound includes natural or synthetic paraffin hydrocarbons of about 15 to about 40 carbons, which are white and translucent waxy solids at ordinary temperature and have a melting point of from about 37° to about 65° C.

Weight proportions of the combination of the polypropylene compound with the paraffin wax to the toner and of the polypropylene compound to the paraffin wax may vary according to the kind of the resin component of toner, coloring agent and the toner additive and to their respective amounts to be added. Generally, however, the sum of amounts of the polypropylene compound and paraffin wax in their combination is 0.1 to 50 parts and preferably 0.5 to 15 parts by weight per 100 parts by weight of the resin component of the toner. In that case, the said combination preferably comprises about 25 to about 400 parts by weight of the paraffin wax per 100 parts by weight of the polypropylene compound. This is because, when the amount of the paraffin wax to be combined with the polypropylene compound is excessively small, such drawback as may be seen in the case of incorporation into the toner of the polypropylene compound only is apt to be brought about and, on the other hand, if the amount of the paraffin wax is excessively large, such drawback as may be seen in the case of incorporation into the toner of the paraffin wax only is apt to be brought about. In the practice of incorporation into the toner of the polypropylene compound in combination with the paraffin wax, the combination may be added to the mixture of the resin component, coloring agent and various toner additives at the time of preliminary mixing step prior to the kneading step. In that case, compatibility of the polypropylene compound to the resin component can be improved by addition of the combination of the polypropylene compound with the paraffin wax in the form of solid solution thereof.

In the present toner, a metal salt of fatty acids may also be used in further combiation with the combination of a styrene type resin and polypropylene with the paraffin wax.

The addition of the metal salt of fatty acids to the present toner acts to exert an extremely preferable influence upon the toner. That is, by addition of the metal salt of fatty acids, compatibility of the polypropylene compound with the resin component is further improved and, in addition, as is the dispersion capability of the paraffin wax, coloring agent and other toner additives such as a charge controlling agent. For that reason, not only can the non-sticking property of the resulting toner be further improved, but also stability of the toner can be markedly enhanced and the toner's life sharply prolonged without being subject to change in frictional charge characteristic even when the toner is used for a long period of time. Furthermore, the moisture resistance of the resulting toner may also be improved.

Representatives of the metal salt of fatty acids used in the present invention include a cadmium, barium, lead, iron, nickel, cobalt, copper, strontium, calcium or magnesium salt of stearic acid; a zinc, manganese, iron, cobalt, copper, lead or magnesium salt of oleic acid; a zinc, cobalt, copper, magnesium, aluminum or calcium salt of palmitic acid; a zinc, cobalt or calcium salt of linoleic acid; a zinc or cadmium salt of ricinolic acid; a lead salt of caprylic acid; a lead salt of caproic acid; and mixtures thereof. The above-mentioned metal salt is incorporated into the toner in an amount of 0.1 to 10 parts by weight per 100 parts of the resin component of the toner comprising the aforesaid combination of the polypropylene compound with the paraffin wax, whereby excellent results as aforesaid can be obtained. Furthermore, other toner additives including a carrier, an electric charge control agent, etc. may be added to the toner, if necessary.

Toner images formed by use of the present toner on a sheet, onto which said images are fixed, may be fixed thereon efficiently and excellently according to the hot roller fixation method without bringing about any offset phenomenon of the toner even when the fixing roller, the surface of which is not provided with any offset-preventing liquid, is used. As the fixing roller, there may be used effectively those having a smooth surface formed from such fluorocarbon resins as Teflon (produced by Du Pont), Fleon (produced by ICl) and Kely-F (produced by 3H) or such relatively hard silicone rubber as KE-1300 RTV (produced by Shinetsu Chemical Industry Co.).

The present invention is illustrated below with reference to examples, but the embodiment of the invention is not limited only thereto. In the following examples, all parts are by weight unless specified otherwise.

EXAMPLE 1

A mixture comprising 100 parts of Picolastic D-150 (a styrene type resin produced and sold by Esso Petrochemical Co.), 5 parts of Peerless 155 (a product produced and sold by Columbia Carbon Co.), 5 parts of Nigrosin Base EX (a product produced and sold by Orient Chemical K.K.) and 10 parts of Viscol 550-P (a low molecular weight polypropylene produced and sold by Sanyo Kasei K.K.) was subjected to a ball mill for about 24 hours and then kneaded by means of a hot roll into a mass. After cooling, the mass was pulverized to prepare a toner having an average particle size of from about 13 to about 15 microns. The toner thus prepared was taken as a sample to be subjected to comparative experiment in accordance with this example. Separately, a toner was prepared in exactly the same procedure as above, except that both the polypropylene was not contained in the mixture, and the toner thus prepared was taken as a control sample.

4 Parts each of the samples was mixed with 96 parts of an iron powder carrier to prepare a developer, said iron powder having an average particle size of from about 50 to about 80 microns. Using each one of the two developers thus prepared, a static image which had been formed according to ordinary procedure of electrophotography was developed. Thereafter, the toner image was transferred onto a transfer sheet and fixed. The fixation was carried out by use of a fixing roller having its surface formed from FLP (a tetrafluoroethylene/hexafluoropropylene copolymer produced and sold by Du Pont), where the transfer sheet bearing the toner image thereon was allowed to contact with the roller at a temperature of 200° to 210° C. so that the image is melted to fix onto the surface of the sheet. Subsequently, a fresh transfer sheet having no toner image thereon was subjected, after completion of the fixation operations using individually the sample toner and the control sample toner, to fixation under the same conditions as above with the view of investigating whether or not the melt-fixed toner image is transferred onto the surface of the fixing roller to cause a so-called offset phenomenon. Each of the transfer sheets thus treated was investigated to observe whether the surface thereof was stained due to occurence of offset of the toner on the roller surface.

As a result, it was observed that when the control sample toner was used, the transfer sheet was markedly stained on its surface due to the offset of toner, whereas no stain was observed on the sheet surface when the sample toner was used. It was thus recognized that in the case of the sample toner, no offset of the toner will occur. Similar results to the above were also observed even after repetition of the fixation operations in the above manner.

EXAMPLE 2

A toner was prepared by treating in the same manner as in Example 1 a mixture comprising 80 parts of Picolastic E-125 (a styrene type resin produced and sold by Esso Petrochemical Co.), 20 parts of S-lec BL-S (a polyvinylbutylal resin produced and sold by Sekisui Chemical Co., Ltd.), 10 parts of Peerless 155, 3 parts of Oil Black BW (a product produced and sold by Orient Chemical K.K.) and 10 parts of Viscol 660-P. Separately, a control sample toner was prepared in exactly the same procedure as above except that the polypropylene and the paraffin wax were not contained in the mixture.

With each one of the two kinds of toners, the same operations as in Example 1 were repeated except that a roller having its surface formed from Teflon (polytetrafluoroethylene produced and sold by Du Pont) and the melt fix temperature employed was 170° to 180° C. to investigate offset property of the toner. As a result, it was observed that when the control sample toner was used, a distinctly marked offset phenomenon occurred, whereas no such phenomenon occurred at all when the sample toner was used.

EXAMPLE 3

A mixture comprising 100 parts of a copolymer of about 80% of styrene and about 20% of dimethylaminoethyl methacrylate, 5 parts of Diablack SH (a product produced and sold by Mitsubishi Chemical Industries, Inc.) and 7 parts of Viscol 660-P was treated in the same manner as in Example 1 to prepare a sample toner. Separately, a control sample toner was prepared exactly in the same procedure as above except that the polypropylene was not contained in the mixture.

Using each one of the two kinds of toners thus prepared, the same operations as in Example 1 were repeated except that a roller having its surface formed from KE-1300 RTV (a silicone rubber produced and sold by Shinetsu Chemical Co., Ltd.) was used as the fixing roller and the melt fix temperature employed was 180° to 190° C., to investigate offset property of the toner.

As a result, a distinct occurrence of the offset phenomenon of toner was recognized when the control sample toner was used, whereas no such phenomenon was recognized at all when the sample toner was used.

EXAMPLE 4

In the same manner as in Example 1, a mixture comprising 100 parts of a copolymer of about 70% styrene and about 30% 3-chloro-2-hydroxypropyl methacrylate, 8 parts of Diablack SH, 5 parts of Oilblack BW and was treated to prepare a toner.

Separately, a control sample toner was prepared exactly in the same procedure as above except that the polypropylene was not contained in the mixture.

With each one of the two kinds of toners thus prepared, the same operations as in Example 1 were repeated except that a roller having its surface formed from Teflon was used as the fixing roller and the melt fix temperature employed was 175° to 185° C., to investigate offset property of the toner. As a result, it was observed that in case the control sample toner was used, a clearly distinct offset phenomenon of toner occurred, whereas no such phenomenon was recognized to occur when the sample toner was used.

EXAMPLE 5

A sample toner was prepared by treating in the same manner as in Example 1 a mixture comprising 100 parts of a copolymer of about 85% of styrene and about 15% of stearyl methacrylate, 5 parts of Peerless 155, 5 parts of Nigrosin Base EX and 10 parts of Viscol 660-P.

Separately, exactly the same procedure was as above repeated except that the polypropylene was not contained in the mixture to prepare a control sample toner.

Using each one of the two kinds of toners thus prepared, the same operations as in Example 1 were repeated except that a roller having its surface formed from Teflon was used the melt as the fixing roller and the fix temperature employed was 190° to 200° C., to investigate offset property of the toner. As a result, it was observed that a distinct offset phenomenon of toner occurred when the control sample toner was used, whereas no occurrence of such phenomenon was recognized at all when the sample toner was used.

EXAMPLE 6

A mixture comprising 100 parts of Picolastic D-150, 5 parts of Diablack SH, 5 parts of Oil Black BS (a product produced and sold by Orient Chemical Co., Ltd.), 5 parts of Viscol 550-P, and 3 parts of zinc stearate was treated in the same manner as in Example 1 to prepare a sample toner. Separately, a control sample toner (A) was prepared in exactly the same procedure as above except that the zinc stearate was not added to the mixture. Further, a control sample toner (B) was prepared in exactly the same procedure as above except that the zinc stearate and the polypropylene were all not contained in the mixture.

Using each one of the three kinds of toners thus prepared, the same operations as in Example 1 were repeated to investigate offset property of the toner. As a result, it was observed that occurrence of a distinct offset phenomenon of toner was recognized when the control sample toner (B) was used, whereas no occurrence of such phenomenon was recognized in each of the cases where the control sample toner (A) and the sample toner were used respectively. After repeating further the above operations, it was recognized that the sample toner has a long life without being subject to change in its frictional charge property for a long period of time, compared with the control sample toner (A).

EXAMPLE 7

A mixture comprising 100 parts of a copolymer of about 65% of styrene and about 35% of butyl methacrylate, 8 parts of Diablack SH, 3 parts of Oil Black BW, 5 parts Viscol 550-P and 2 parts of lead stearate was treated in the same manner as in Example 1 to prepare a sample toner. Separately, a control sample toner (A) was prepared in exactly the same procedure as in the sample toner except that the lead stearate was not added to the mixture. Further, a control sample toner (B) was prepared according to exactly the same procedure as in the sample toner except that the lead stearate and the polyethylene were all not added to the mixture.

Using each one of the three kinds of toners thus prepared, the same operations as in Example 1 were repeated except that a roller having its surface formed from Teflon was used as the fixing roller and the melt fixing temperature employed was 180° to 190° C. to investigate offset property of the toner. As a result, it was recognized when the control sample toner (B) was used, a distinct offset phenomenon of toner occurs, whereas no such phenomenon occurred at all in case where the control sample toner (A) or the sample toner was used. After repeating further the same operations, it was recognized that the sample toner had a long life without being subject to change in its frictional charge property for a long period of time, compared with the control sample toner (A).

EXAMPLE 8

A mixture comprising 100 parts of a copolymer of about 50% of styrene, about 30% of butyl methacrylate and about 20% of methyl methacrylate, 40 parts of Picolastic D-150, 5 parts of Peerless 155, 5 parts of Nigrosin Base EX, 8 parts of Viscol 660-P and 5 parts of barium stearate was treated in the same manner as in Example 1 to prepare a sample toner. Separately, a control sample toner (A) was prepared in exactly the same procedure as in the sample toner except that the barium stearate was not added to the mixture. Further, a control sample toner (B) was prepared according to exactly the same procedure as in the sample toner except that the barium stearate and the polypropylene were all not contained in the mixture.

Using each one of the three kinds of toners, the same operations as in Example 1 were repeated except that the melt fixing temperature employed was 180° to 190° C. to investigate offset property of the toner. As a result, it was recognized that a distinct offset phenomenon occurs when the control sample toner (B) was used, while no such phenomenon occurred at all in case where the control sample toner (A) or the sample toner was used.

After repeating further the above operations, it was recognized that the sample toner has a long life without being subject to change in its frictional charge property for a long period of time, compared with the control sample toner (A).

EXAMPLE 9

A mixture comprising 80 parts of a copolymer of about 80% of styrene and about 20% of ethyl methacrylate, and 20 parts of Vinylite VYLF (a copolymer of about 87 parts of vinyl chloride and about 20 parts of ethyl methacrylate produced and sold by Bakelite Corp.), 8 parts of Dia Black SH, 5 parts of Nigrosin Base EX, 3 parts of Viscol 660-P and 2 parts of Hoechst Wax PA 190 (a low molecular weight polyethylene produced and sold by Hoechst AG) was treated in the manner similar to that in Example 1 to prepare a toner which was then taken as a sample. Separately, a toner was prepared according to exactly the same manner as above except that the polypropylene was not contained in the mixture, and the toner was taken as a control sample.

Using individually the two kinds of toners thus prepared, the same operations as in Example 1 were repeated except that the melt fixing temperature employed was from 190° to 200° C. The toners were tested for their offset property. As a result, it was observed that when the control sample toner was used, the offset phenomenon of toner occurred distinctly, whereas no such phenomenon occurred at all when the sample toner was used.

EXAMPLE 10

A toner was prepared in the same procedure as in Example 1 except that 5 parts instead of 10 parts of Viscol 550-P was used and 3 parts of Plastflow (ethylenebisstearoylamide produced and sold by Nitto Chemical Co., Ltd.), and the toner was taken as a sample. Separately, a control sample toner (A) was prepared exactly in the same procedure as above except that the Plastflow was not added, and the toner thus prepared was taken as a control sample. Further, a control sample toner (B) was prepared exactly in the same procedure except that both the Plastflow and the polypropylene were not contained in the mixture.

Using individually the three kinds of toners thus prepared, the same operations as in Example 1 were repeated except that a roller having its surface formed from KE-12 RTV (a silicone rubber produced and sold by Shinetsu Chemical Co., Ltd.) was used as the fixing roller and the melt fixing temperature employed was 180° to 190° C., and the toners were investigated for their offset property. As a result, it was observed that when the control sample toner (B) was used, a distinct occurrence of offset phenomenon of the toner was recognized, whereas no occurrence of offset phenomenon of the toner was recognized at all when the sample toner or the control sample toner (A) was used. At the time of pulverization in the course of preparing the toner, it was observed that the sample toner was less liable to excessive pulverization, compared with the control sample toner (A).

EXAMPLE 11

A sample toner was prepared in the same procedure as in Example 1 except that 5 parts instead of 10 parts of Viscol 550-P was used in and 3 parts of Sazol Wax HI (a high melting synthetic paraffin produced and sold by Sazol Marketing Co.) was added to the mixture. Separately, a control sample toner (A) was prepared by repeating exactly the same procedure as above except that the Sazol Wax HI was not added to the mixture. Further, a control sample toner (B) was prepared exactly in the same procedure as above except that both the Sazol Wax HI and the polypropylene were not added to the mixture.

Using individually the three kinds of toners thus prepared, the same operations as in Example 1 were repeated to investigate offset property of the respective toners. As a result, it was observed that a distinct offset phenomenon was recognized when the control sample toner (B) was used, whereas no occurrence of such phenomenon was recognized when the control sample toner (A) and the sample toner were used in each case. It was recognized, moreover, that at the time of pulverization in the course of preparing the toner, the sample toner was less liable to excessive pulverization, compared with the control sample (A).

EXAMPLE 12

A mixture comprising 80 parts of a copolymer of about 80% of styrene and about 20% of ethyl methacrylate, 8 parts of Dia Black SH, 5 parts of Nigrosin Base EX, 3 parts of Viscol 660-P and 2 parts of Hoechst Wax S (a higher fatty acid produced and sold by Hoechst AG) was treated in the same manner as in Example 1 to prepare a sample toner. Separately, a control sample toner was prepared in exactly the same procedure as above except that the polypropylene was not added to the mixture.

Using individually the two kinds of toners thus prepared, the same operations as in Example were repeated except that the melt fixing temperature employed was 155° to 165° C. to investigate offset property of the respective toners. As a result, it was observed that the offset phenomenon occurred to some extent when the control sample toner was used, whereas no occurrence of such phenomenon was recognized in case where the sample toner was used.

EXAMPLE 13

A mixture comprising 80 parts of a copolymer of about 80% of styrene and about 20% of ethyl methacrylate, 20 parts of Vinylite VYLF, 8 parts of Dia Black, 5 parts of Nigrosin Base EX, 3 parts of Viscol 660-P, 2 parts of Hoechst Wax PA 190, 3 parts of Hoechst Wax S and 1 part of calcium palmitate was treated in the same procedure as in Example 1 to obtain a sample toner.

Separately, a control sample toner was prepared by repeating exactly the same procedure as above except that the polypropylene was not added to the mixture.

Using individually the two kinds of toners thus prepared, the same operations as in Example 1 were repeated except that a roller having its surface formed from KE-12 RTV was used as the fixing roller and the melt fixing temperature employed was 160° to 170° C. to investigate offset property of the respective toners. As a result, it was observed that an occurrence of the offset phenomenon of toner was recognized when the control sample toner was used, whereas no occurrence of such phenomenon was recognized at all when the sample toner was used. As a result of repeated use of the present sample toner, it was observed that had a long life without being subject to change in its frictional charging property for a long period of time.

EXAMPLE 14

A mixture comprising 100 parts of Picolastic D-150 (a styrene type resin produced and sold by Esso Petrochemical Co.), 5 parts of Peerless 155 (a product produced and sold by Columbia Carbon Co.), 5 parts of Nigrosin Base EX (a product produced and sold by Orient Chemical K.K.), 2 parts of Viscol 550-P (a low molecular weight polypropylene produced and sold by Sanyo Kasei K.K.) and 5 parts of paraffin wax 135° (a product produced and sold by Nippon Oil K.K.) was subjected to a ball mill for about 24 hours and then kneaded by means of a hot roll into a mass. After cooling, the mass was pulverized to prepare a toner having an average particle size of from about 13 to about 15 microns. The toner thus prepared was taken as a sample to be subjected to comparative experiment in accordance with this example. Separately, a toner was prepared in exactly the same procedure as above, except that both the polypropylene and paraffin were not contained in the mixture, and the toner thus prepared was taken as a control sample.

4 Parts each of the samples was mixed with 96 parts of an iron powder carrier to prepare a developer, said iron powder having an average grainsize of from about 50 to about 80 microns. Using each one of the two developers thus prepared, a static image which had been formed according to ordinary procedure of electrophotography was developed. Thereafter, the toner image was transferred onto a transfer sheet and fixed. The fixation was carried out by use of a fixing roller having its surface formed from FEP (a tetrafluoroethylene/hexafluoropropylene copolymer produced and sold by Du Pont), where the transfer sheet bearing the toner image thereon was allowed to contact with the roller at a temperature of 185° to 195° C. so that the image is melted to fix onto the surface of the sheet. Subsequently, a fresh transfer sheet having no toner image thereon was subjected, after completion of the fixation operations using individually the same toner and the control sample toner, to fixation under the same conditions as above with the view of investigating whether or not the melt-fixed toner image is transferred onto the surface of the fixing roller to cause a so-called offset phenomenon. Each of the transfer sheets thus treated was investigated to observe whether the surface thereof was stained due to occurrence of offset of the toner on the roller surface.

As a result, it was observed that when the control sample toner was used, the transfer sheet was markedly stained on its surface due to the offset of toner, whereas no stain was observed on the sheet surface when the sample toner was used. It was thus recognized that in the case of the sample toner, no offset of the toner will occur. Similar results to the above were also observed even after repetition of the fixation operations in the above manner.

EXAMPLE 15

A mixture comprising 50 parts of Picolastic D-150, 50 parts of Picolastic D-125 (a styrene type resin produced and sold by Esso Petrochemical Co.), 5 parts of Dia Black SH (a product produced and sold by Mitsubishi Chemical Industries, Inc.), 5 parts of Oil Black BS (a product produced and sold by Sanyo Kasei K.K.), 3 parts of Viscol 660-P (a low molecular weight polypropylene), 2 parts of AC polyethylene 6A and 5 parts of paraffin wax 140 (a product produced and sold by Nippon Oil K.K.) was treated in the manner similar to that in Example 14 to prepare a toner which was then taken as a sample. Separately, a toner was prepared according to exactly the same manner as above except that the polypropylene, the polyethylene and the paraffin wax were not contained in the mixture, and the toner was taken as a control sample.

Using individually the two kinds of toners thus prepared, the same operations as in Example 1 were repeated except that the melt fixing temperature employed was from 170° to 180° C. The toners were tested for their offset property. As a result, it was observed that when the control sample toner was used, the offset phenomenon of toner occurred distinctly, whereas no such phenomenon occurred at all when the sample toner was used.

EXAMPLE 16

A sample toner was prepared by treating in the same manner as in Example 1 a mixture comprising 80 parts of Picolastic E-125 (a styrene type resin produced and sold by Esso Petrochemical Co.), 20 parts of S-lec BL-S (a polyvinylbutylal resin produced and sold by Sekisui Chemical Co., Ltd.), 10 parts of Peerless 155, 3 parts of Oil Black BW (a product produced and sold by Orient Chemical K.K.), 10 parts of Viscol 660-P and 3 parts of paraffin wax 135°. Separately, a control sample toner was prepared in exactly the same procedure as above except that the polypropylene and the paraffin wax were not contained in the mixture.

With each one of the two kinds of toners, the same operations as in Example 1 were repeated except that a roller having its surface formed from Teflon (polytetrafluoroethylene produced and sold by Du Pont) and the melt fix temperature employed was 160° to 170° C. to investigate offset property of the toner. As a result, it was observed that when the control sample toner was used, a distinctly marked offset phenomenon occurred, whereas no such phenomenon occurred at all when the sample toner was used.

EXAMPLE 17

A mixture comprising 100 parts of a copolymer of about 70% of styrene and about 30% of butyl methacrylate, 1 part of Viscol 550-P and 4 parts of paraffin wax was treated in the same manner as in Example 14 to prepare a sample toner. Separately, a control sample toner was prepared exactly in the same procedure as above except that both the polypropylene and the paraffin wax were not contained in the mixture.

Using each one of the two kinds of toners thus prepared, the same operations as in Example 14 were repeated except that a roller having its surface formed from KE-1300 RTV (a silicone rubber produced and sold by Shinetsu Chemical Co., Ltd.) was used as the fixing roller and the melt fix temperature employed was 175° to 185° C., to investigate offset property of the toner. As a result, it was observed that a distinct occurrence of the offset phenomenon of toner was recognized when the control sample toner was used, whereas no such phenomenon was recognized at all when the sample toner was used.

EXAMPLE 18

A sample toner was prepared by treating in the same manner as in Example 14 a mixture comprising 40 parts of Picolastic E-125, 30 parts of Picolastic D-150, 10 parts of S-lec BL-1 (a polyvinylbutylal resin produced and sold by Sekisui Chemical Co., Ltd.), 20 parts of Dianal BR-102 (a butyl polymethacrylate resin produced and sold by Mitsubishi Rayon Co., Ltd.), 5 parts of Dia Black SH, 5 parts of Nigrosin Base EX, 10 parts of Viscol 550-P and 3 parts of paraffin wax 135°. Separately, exactly the same procedure was as above repeated except that both the polypropylene and the paraffin wax were not contained in the mixture to prepare a control sample toner.

Using each one of the two kinds of toners thus prepared, the same operations as in Example 14 were repeated except that the melt fix temperature employed was 170° to 180° C., to investigate offset property of the toner. As a result, it was observed that a distinct offset phenomenon of toner was recognized to occur when the control sample toner was used, whereas no occurrence of such phenomenon was recognized at all when the sample toner was used.

EXAMPLE 19

In the same manner as in Example 14, a mixture comprising 80 parts of a copolymer of about 80% styrene and about 20% ethyl methacrylate, 20 parts of Vinylite VYLF (a copolymer of about 87 parts vinyl chloride and about 13 parts vinyl acetate produced and sold by Bakelite K.K.), 8 parts of Dia Black SH, 5 parts of Nigrosin Base EX, 3 parts of Viscol 660-P, 2 parts of Hoechst Wax Pa 190 (a low molecular weight polyethylene produced and sold by Hoechst Co.) and 5 parts of paraffin wax 140° was treated to prepare a sample toner. Separately, a control sample toner was prepared exactly in the same procedure as above except that the polypropylene, the polyethylene and the paraffin wax were all not contained in the mixture.

With each one of the two kinds of toners thus prepared, the same operations as in Example 14 were repeated except that the melt fix temperature employed was 175° to 185° C., to investigate offset property of the toner. As a result, it was observed that in case the control sample toner was used, a clearly distinct offset phenomenon of toner was recognized to occur, whereas no occurrence of such phenomenon was recognized to occur when the sample toner was used.

EXAMPLE 20

A mixture comprising 100 parts of Picolastic D-150, 5 parts of Dia Black SH, 5 parts of Oil Black BS, 2 parts of Viscol 550-P, 5 parts of paraffin wax 135° and 3 parts of zinc stearate was treated in the same manner as in Example 14 to prepare a sample toner. Separately, a control sample toner (A) was prepared in exactly the same procedure as above except that the zinc stearate was not added to the mixture. Further, a control sample toner (B) was prepared in exactly the same procedure as above except that the zinc stearate, the polypropylene and the paraffin wax were all not contained in the mixture.

Using each one of the three kinds of toners thus prepared, the same operations as in Example 14 were repeated to investigate offset property of the toner. As a result, it was observed that occurrence of a distinct offset phenomenon of toner was recognized when the control sample toner (B) was used, whereas no occurrence of such phenomenon was recognized in each of the cases where the control sample toner (A) and the sample toner were used respectively. After repeating further the above operations, it was recognized that the sample toner has a long life without being subject to change in its frictional charge property for a long period of time, compared with the control sample toner (A).

EXAMPLE 21

A mixture comprising 40 parts of Picolastic D-150, 40 parts of Picolastic D-125, 20 parts of S-lec BM-2 (a polyvinyl butylal resin produced and sold by Sekisui Chemical Co., Ltd.), 8 parts of Peerless 155, 5 parts of Nigrosin Base EX, 5 parts of Viscol 660-P, 5 parts of paraffin wax 140° and 1 part of calcium palmitate was treated in the same manner as in Example 14 to prepare a sample toner. Separately, a control sample toner (A) was prepared in exactly the same procedure as in the sample toner except that the calcium palmitate was not added to the mixture. Further, a control sample toner (B) was prepared according to exactly the same procedure as in the sample toner except that the calcium palmitate, the polypropylene and the paraffin wax were all not contained in the mixture.

Using each one of the three kinds of toners, the same operations as in Example 14 were repeated except that a roller having its surface formed from KE-12 RTV was used as the fixing roller and the melt fixing temperature employed was 160° to 170° C. to investigate offset property of the toner. As a result, it was recognized that a distinct offset phenomenon occurs when the control sample toner (B) was used, while no such phenomenon occurred at all in case where the control sample toner (A) or the sample toner was used. After repeating further the above operations, it was recognized that the sample toner has a long life without being subject to change in its frictional charge property for a long period of time, compared with the control sample toner (A).

EXAMPLE 22

A mixture comprising 100 parts of a copolymer of about 65 parts of styrene and about 35% of butyl methacrylate, 8 parts of Dia Black SH, 3 parts of Oil Black BW, 5 parts of Hoechst Wax PA 190, 5 parts of paraffin wax 140° and 0.5 part of lead stearate was treated in the same manner as in Example 14 to prepare a sample toner. Separately, a control sample toner (A) was prepared in exactly the same procedure as in the sample toner except that the lead stearate was not added to the mixture. Further, a control sample toner (B) was prepared according to exactly the same procedure as in the sample toner except that the lead stearate, the polyethylene and the paraffin wax were all not added to the mixture.

Using each one of the three kinds of toners thus prepared, the same operations as in Example 14 were repeated except that a roller having its surface formed from Teflon was used as the fixing roller and the melt fixing temperature employed was 180° to 190° C. to investigate offset property of the toner. As a result, it was recognized when the control sample toner (B) was used, a distinct offset phenomenon of toner occurs, whereas no such phenomenon occurred at all in case where the control sample toner (A) or the sample toner was used. After repeating further the same operations, it was recognized that the sample toner has a long life without being subject to change in its frictional charge property for a long period of time, compared with the control sample toner (A).

What we claim is:

1. A toner for developing electrostatic images comprising (a) a styrene homopolymer or copolymer of styrene with at least one acrylic comonomer, and (b) about 1.0 to about 10 parts by weight of polypropylene per 100 parts by weight of said styrene homopolymer or copolymer, said polypropylene having a number average molecular weight of about 3,000 to about 4,000.

2. The toner of claim 1 wherein said copolymer is of styrene and at least one comonomer.

3. The toner of claim 1 wherein said comonomer is acrylic acid or a derivative thereof of the formula

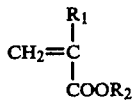

wherein $R_1$ is H or alkyl, $R_2$ is H, substituted or unsubstituted alkyl, or substituted or unsubstituted aryl.

4. The toner of claim 3 wherein $R_1$ is H or methyl.

5. The toner of claim 3 wherein $R_1$ is unsubstituted.

6. The toner of claim 1 wherein said comonomer is selected from the group consisting of acrylic acid, methacrylic acid, and derivatives thereof.

7. The toner of claim 1 wherein said comonomer is selected from the group consisting of methyl acrylate, ethyl acrylate, n-butyl acrylate, isobutyl acrylate, dodecyl acrylate, octyl acrylate, chloroethyl acrylate, phenyl acrylate, stearyl acrylate, methyl chloroacrylate; methyl methacrylate, ethyl methacrylate, butyl methacrylate, dodecyl methacrylate, octyl methacrylate, chloroethyl methacrylate, phenyl methacrylate, stearyl methacrylate, methyl chloromethacrylate, and mixtures thereof.

8. The toner of claim 1 further comprising a paraffin wax.

9. The toner of claim 1 further comprising a charge control agent.

10. The toner of claim 8 wherein said paraffin wax is selected from the group consisting of natural and synthetic $C_{15}$ to $C_{40}$ hydrocarbons which are normally solid and have melting points of about 37° to about 65° C.

11. The toner of claim 8 further comprising a metal salt of a fatty acid.

12. The toner of claim 11 wherein said fatty acid metal salt is selected from the group consisting of a cadmium, barium, lead, iron, nickel, cobalt, copper, strontium, calcium or magnesium salt of stearic acid, a zinc, manganese, iron, cobalt, copper, lead or magnesium salt of oleic acid, a zinc, cobalt, copper, magnesium, aluminum or calcium salt of palmitic acid; a zinc, cobalt or calcium salt of palmitic acid; a zinc, cobalt or calcium salt of linoleic acid; a zinc or cadmium salt or ricinolic acid; a lead salt of caprylic acid; a lead salt of caproic acid; and mixtures thereof.

13. The toner of claim 1 further comprising a coloring agent.

* * * * *